US006289882B1

(12) United States Patent
Slicker

(10) Patent No.: US 6,289,882 B1
(45) Date of Patent: Sep. 18, 2001

(54) CONTROLLED ENGAGEMENT OF SUPERCHARGER DRIVE CLUTH

(75) Inventor: James M. Slicker, West Bloomfield, MI (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/502,415

(22) Filed: Feb. 10, 2000

(51) Int. Cl.[7] ..... F02B 33/00
(52) U.S. Cl. ..... 123/559.3; 60/611
(58) Field of Search ..... 123/559.1, 559.3; 60/611

(56) References Cited

U.S. PATENT DOCUMENTS 4,498,429 * 2/1985 Satow et al. ..... 123/559.3 X
4,669,441 * 6/1987 Okimoto ..... 123/559.3
4,708,119 * 11/1987 Miyake ..... 123/559.3
5,150,693 * 9/1992 Ohnaka et al. ..... 123/559.3

* cited by examiner

*Primary Examiner*—Hoang Nguyen
(74) *Attorney, Agent, or Firm*—L. J. Kasper

(57) ABSTRACT

A supercharger clutch system has a clutch housing (52) in which a clutch pack (84) is disposed to transmit torque from an input, such as a pulley (66), to one of the timing gears (58). The clutch pack (84) is disposed within a cage (92), having a spring seat member (98) adjacent thereto. A set of springs (104) biases the seat member and the clutch cage (92) to engage the clutch pack (84). On the opposite side, axially, of the clutch pack there is a piston (76) including a portion (80) surrounding the clutch cage (92) and engaging the seat member (98). The piston (76) and the clutch housing (52) define a pressure chamber (106) which, when pressurized, causes movement of the piston in a direction compressing the springs (104) and disengaging the clutch pack. The invention provides a method of controlling the clutch system by means of an electrohydraulic valve (110) which can communicate the pressure chamber (106) to either high pressure (112) or low pressure (132). The valve (110) is controlled by sensing throttle position (141) and modifying a command signal (130) to a coil (126) of the valve (110) in response to the throttle position (141), so that the rate of clutch engagement may be modulated in response to throttle position.

5 Claims, 6 Drawing Sheets

CONTROLLED ENGAGEMENT OF SUPERCHARGER DRIVE CLUTH

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE DISCLOSURE

The present invention relates to a rotary blower, such as a supercharger for supercharging an internal combustion engine. More particularly, the invention relates to a supercharger having a fluid pressure operated clutch assembly adapted to transmit torque from an input to one of the supercharger rotors.

Although the present invention may be used advantageously with superchargers having various rotor types and configurations, such as the male and female rotors found in screw compressors, it has been developed for use with a Roots blower type of supercharger, and will be described in connection therewith.

As is well known to those skilled in the art, the use of a supercharger to increase or "boost" the air pressure in the intake manifold of an internal combustion engine results in an engine having greater horsepower output capability than would occur if the engine were normally aspirated, (i.e., if the piston would draw air into the cylinder during the intake stroke of the piston). However, the conventional supercharger is mechanically driven by the engine, and therefore, represents a drain on engine horsepower whenever engine boost is not required. For the above and other reasons, it has been known for several years to provide some sort of engageable/disengageable clutch assembly disposed in series between the input (e.g., a belt driven pulley) and the blower rotors.

The assignee of the present invention has sold superchargers commercially including such clutch assemblies which operate electromagnetically. Unfortunately, the ON-OFF characteristics of electromagnetic clutches produce a transient load torque on the engine. For example, as the electromagnetic clutch is engaged, the result will be a "droop" in engine speed which will likely be perceived by the driver and may be manifested as an undesirable slowing down of the vehicle.

It is also known to provide a fluid pressure operated clutch assembly in which the clutch pack is spring biased toward a disengaged condition, and is moved toward an engaged condition in response to axial movement of a fluid pressure actuated piston member. In other words, the known supercharger clutch is of the "pressure-applied, spring-released" type. Although a supercharger with such a clutch arrangement can operate in a generally satisfactory manner, once the clutch is in either the engaged or the disengaged condition, the known arrangement does involve certain disadvantages during "transient" conditions, i.e., as the clutch assembly changes from the disengaged condition to the engaged condition, or vice versa. By way of example, a known supercharger clutch assembly of the pressure applied, spring released type requires a fairly long piston travel in order to achieve engagement of the clutch pack (or very high apply pressure), thus requiring substantial flow of fluid to accomplish the required piston movement.

Although such a high flow requirement is not a problem, once the engine has reached normal operating temperature, it frequently occurs that engagement of the clutch assembly is required soon after "cold engine start up", while the engine oil is still cold. As a result, the known pressure applied, spring released system will have substantially longer time of engagement when the engine is cold than when the engine is warm. By way of example only, a typical engagement or release response time, as specified by the vehicle manufacturer, would be in the range of about 0.10 seconds. A substantially longer response time would result in the well known "turbo lag" feeling wherein the operator depresses the accelerator, but then there is a time lag before engine boost becomes noticeable, as is inherent in a turbo charger type of engine boost system. On the other hand, response time should not be so fast (when engaging) and so sudden as to result in a large torque spike being imposed upon the engine.

Another disadvantage associated with the pressure-applied type of supercharger clutch is that the oil pressure typically used is the engine lubrication oil circuit. As a result, the fluid pressure available to engage the clutch may be only in the range of about 20 psi., and even that very low pressure may not be available on a sufficiently consistent and predictable basis to be relied upon for engagement of the supercharger clutch, especially within the specified response time.

BRIEF SUMMARY OF THE INVENTION

Accordingly, it is an object of the present invention to provide an improved supercharger and clutch assembly which overcome the above-described disadvantages of the prior art.

It is a more specific object of the present invention to provide an improved supercharger and clutch assembly which accomplishes the above-stated object, and which has both a variable and a controllable engagement and disengagement response time, thus avoiding transient overloading of the engine as well as a time lag upon engagement.

It is a further object of the present invention to provide such an improved supercharger and clutch assembly which operates in a consistent manner, substantially independent of variables such as engine oil temperature.

The above and other objects of the invention are accomplished by the provision of an improved method of controlling a rotary blower of the back flow or compression type having an input, a housing defining a blower chamber, and a pair of blower rotors disposed in the blower chamber and adapted to be driven by the input. A wet clutch is disposed in series driving relationship between the input and the blower rotors. The wet clutch includes spring means biasing the wet clutch toward one of an engaged in a disengaged condition, and a fluid pressure actuated piston having a pressure chamber biasing the wet clutch toward the other of the engaged and disengaged conditions.

The improved method of controlling the rotary blower is characterized by providing an electrohydraulic valve means operable to communicate the pressure chamber selectively to a source of high pressure and a source of low pressure. The method includes generating a command signal operable to bias the electrohydraulic valve means toward a position operable to communicate the pressure chamber to the source of whichever of the high pressure and the low pressure corresponds to the engaged condition. The method includes sensing a throttle position representative of change in commanded throttle position for the vehicle engine, and modifying the command signal in response to the throttle position whereby a change between the engaged and the disengaged conditions will occur more rapidly for a more rapid change in commanded throttle position.

DETAILED DESCRIPTION OF THE PREFERRED EMBODIMENT

Figure 1:
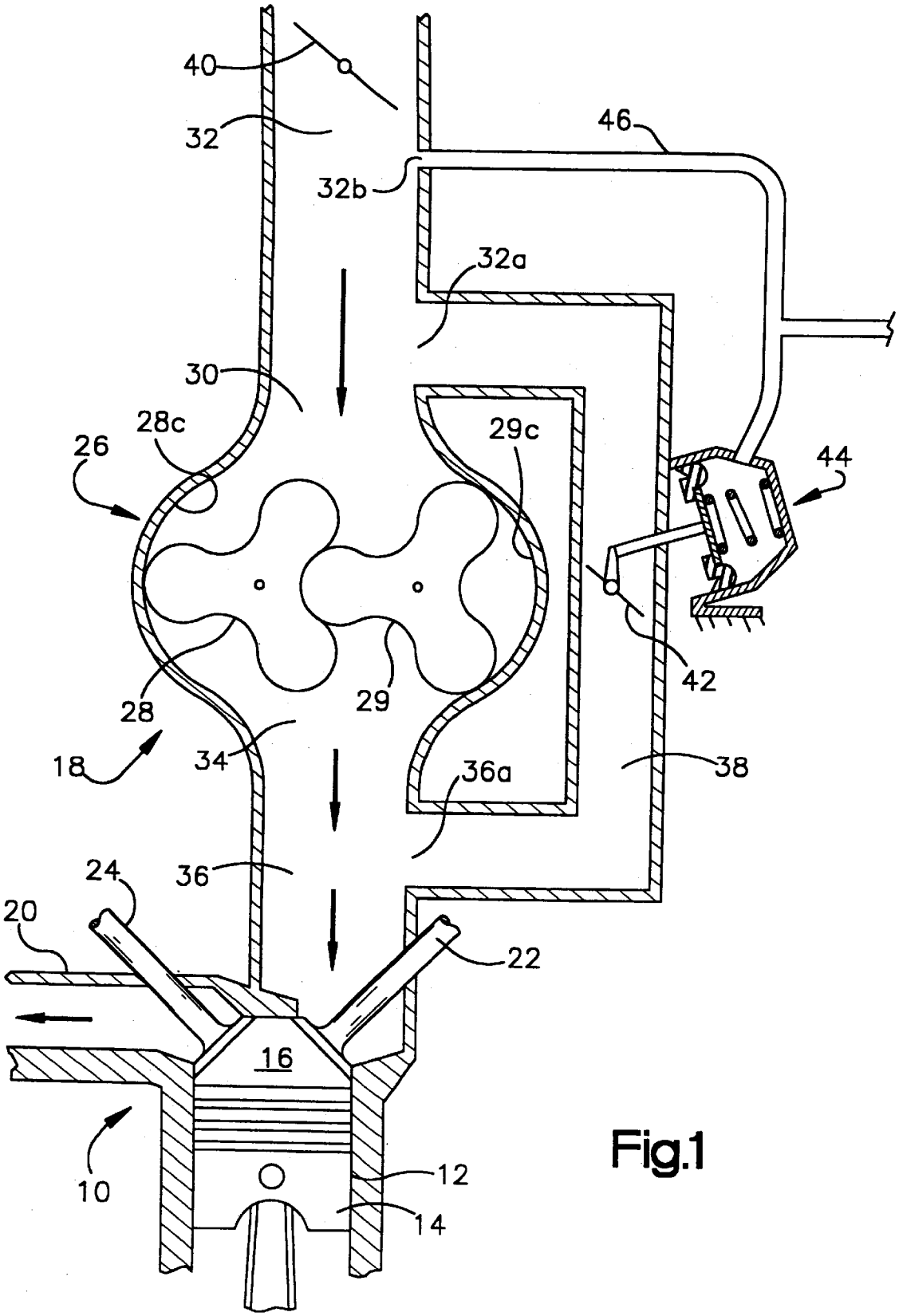
FIG. 1 is a schematic illustration of an intake manifold assembly having disposed therein a supercharger of the type which may utilize the present invention.

Referring now to the drawings, which are not intended to limit the invention, FIG. 1 is a schematic illustration of an intake manifold assembly, including a Roots blower supercharger and bypass valve arrangement of the type which is now well known to those skilled in the art. An engine, generally designated 10, includes a plurality of cylinders 12, and a reciprocating piston 14 disposed within each cylinder, thereby defining an expandable combustion chamber 16. The engine includes intake and exhaust manifold assemblies 18 and 20, respectively, for directing combustion air to and from the combustion chamber 16, by way of intake and exhaust valves 22 and 24, respectively.

The intake manifold assembly 18 includes a positive displacement rotary blower 26 of the backflow or Roots type, as is illustrated and described in U.S. Pat. Nos. 5,078,583 and 5,893,355, assigned to the assignee of the present invention and incorporated herein by reference. The blower 26 includes a pair of rotors 28 and 29, each of which includes a plurality of meshed lobes. The rotors 28 and 29 are disposed in a pair of parallel, transversely overlapping cylindrical chambers 28*c* and 29*c*, respectively. The rotors may be driven mechanically by engine crankshaft torque transmitted thereto in a known manner, such as by means of a drive belt (not illustrated herein). The mechanical drive rotates the blower rotors at a fixed ratio, relative to crankshaft speed, such that the blower displacement is greater than the engine displacement, thereby boosting or supercharging the air flowing to the combustion chambers 16.

The supercharger or blower 26 includes an inlet port 30 which receives air or air-fuel mixture from an inlet duct or passage 32, and further includes a discharge or outlet port 34, directing the charged air to the intake valves 22 by means of a duct 36. The inlet duct 32 and the discharge duct 36 are interconnected by means of a bypass passage, shown schematically at 38. If the engine 10 is of the Otto cycle type, a throttle valve 40 preferably controls air or air-fuel mixture flowing into the intake duct 32 from a source, such as ambient or atmospheric air, in a well known manner. Alternatively, the throttle valve 40 may be disposed downstream of the supercharger 26.

Disposed within the bypass passage 38 is a bypass valve 42 which is moved between an open position and a closed position by means of an actuator assembly, generally designated 44. The actuator assembly 44 is responsive to fluid pressure in the inlet duct 32 by means of a vacuum line 46. Therefore, the actuator assembly 44 is operative to control the supercharging pressure in the discharge duct 36 as a function of engine power demand. When the bypass valve 42 is in the fully open position, air pressure in the duct 36 is relatively low, but when the bypass valve 42 is fully closed, the air pressure in the duct 36 is relatively high. Typically, the actuator assembly 44 controls the position of the bypass valve 42 by means of suitable linkage. Those skilled in the art will understand that the illustration herein of the bypass valve 42 is by way of generic explanation and example only, and that, within the scope of the invention, various other bypass configurations and arrangements could be used, such as a modular (integral) bypass or an electronically operated bypass, or in some case, no bypass at all.

Figure 2:
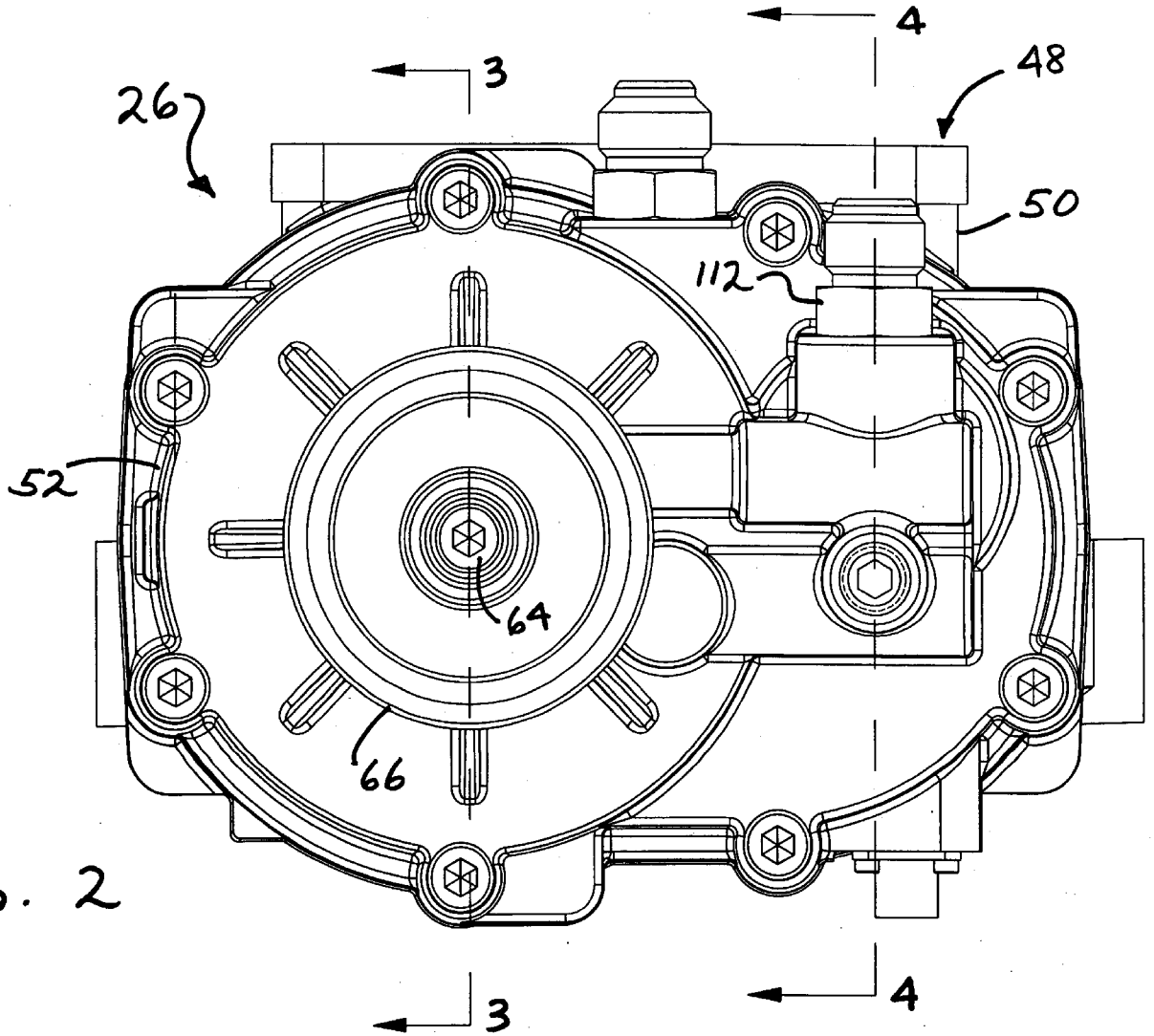
FIG. 2 is a front plan view of the supercharger shown schematically in FIG. 1.
Figure 3:
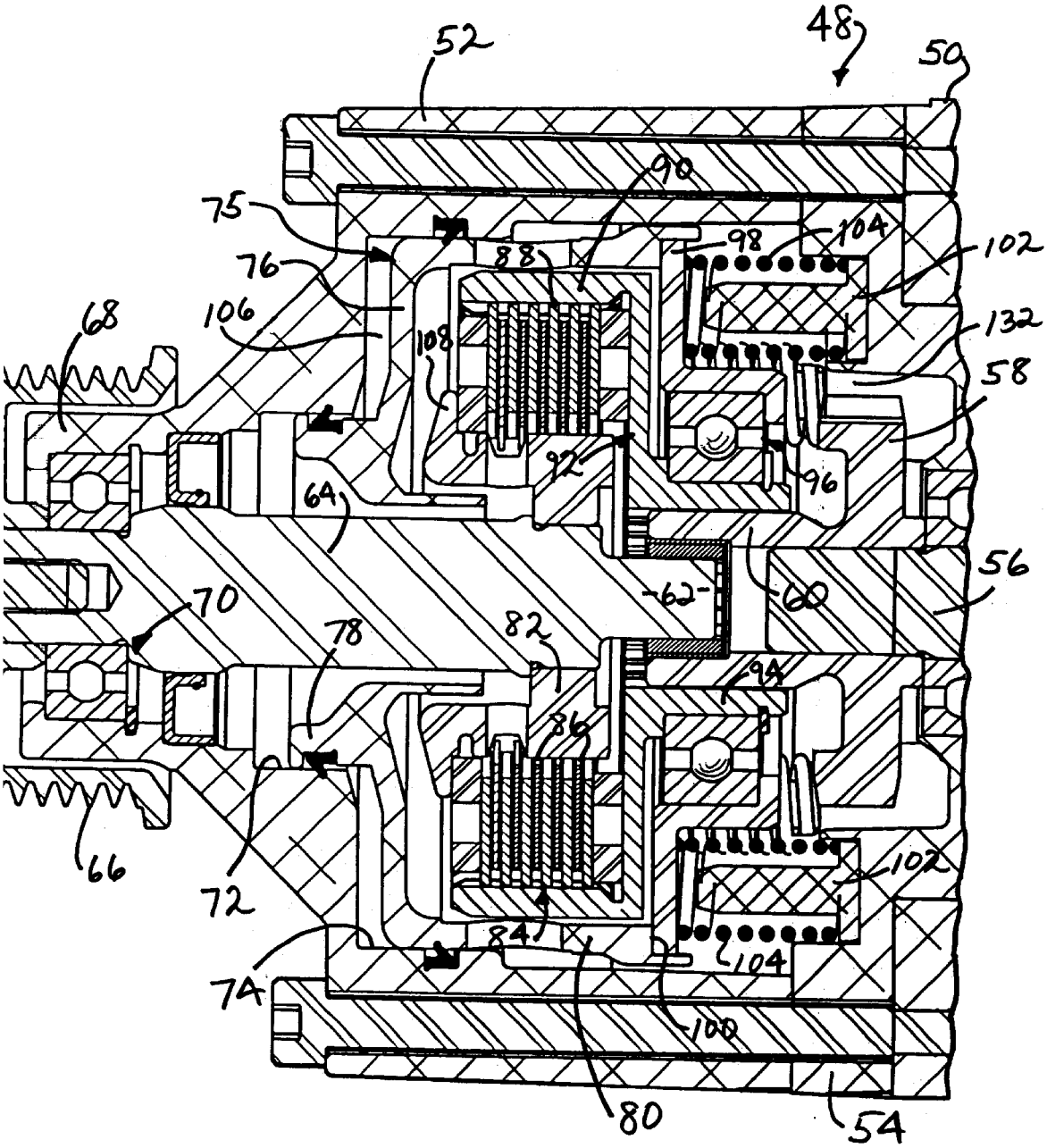
FIG. 3 is an enlarged, fragmentary, axial cross-section taken on line 3—3 of FIG. 2, and showing primarily the clutch assembly to be controlled by the method of the present invention, the clutch assembly being shown in its engaged condition.

Referring now primarily to FIGS. 2 and 3, the blower 26 includes a housing assembly generally designated 48, which includes a main housing 50 (shown only fragmentarily in FIG. 3), which defines the chambers 28*c* and 29*c*. The housing assembly 48 also includes an input housing 52, also referred to hereinafter as a clutch housing. Disposed axially between the main housing 50 and the clutch housing 52 is a bearing plate 54 through which extends a forward end of a rotor shaft 56, on which is mounted the rotor 28.

As is well known to those skilled in the art of superchargers, a timing gear 58 is pressed onto the forward end of the rotor shaft 56, and in the subject embodiment, the timing gear 58 includes an input hub 60. Journalled within the forward end (left end in FIG. 3) of the input hub 60 is a reduced diameter portion 62 of an input shaft 64. Disposed about a forward end of the input shaft 64 is an input pulley 66, by means of which torque is transmitted from the engine crankshaft (not shown) to the input shaft 64. It should be noted that the input pulley 66 is shown only fragmentarily in FIG. 3. The input pulley 66 surrounds a reduced diameter portion 68 of the clutch housing 52, and disposed radially between the input shaft 64 and the portion 68 is a bearing set 70.

The clutch housing 52 defines a relatively smaller internal diameter 72, also referred to hereinafter as a cylindrical surface 72, and a relatively larger internal diameter 74, also referred to hereinafter as a cylindrical surface 74. The cylindrical surfaces 72 and 74 comprise a clutch chamber which will hereafter also bear the reference "74". Disposed within the clutch chamber 74 is a clutch assembly, generally designated 75, including a clutch piston 76, including a reduced diameter portion 78 which is in sealing engagement with the smaller cylindrical surface 72, and a larger cylindrical portion 80 which is in sealing engagement with the cylindrical surface 74.

A splined drive member 82 is in driven engagement with the input shaft 64 by any suitable means, such as a press-fit relationship. Surrounding the drive member 82 is a clutch pack, generally designated 84, including a set of internally splined clutch disks 86, which are in splined engagement with the drive member 82. Interleaved with the disks 86 is a set of externally splined clutch disks 88, which are in splined engagement with internal splines defined by a cylindrical portion 90 of a clutch housing or cage 92. The clutch cage 92 also includes a relatively smaller cylindrical portion 94 which is in a splined relationship with the input hub 60, such that there can be relative axial movement therebetween, for reasons which will become apparent subsequently. Therefore, whenever the clutch pack 84 is engaged, input torque is transmitted from the input pulley 66 through the input shaft 64 to the splined drive member 82, and from there through the clutch pack 84 to the clutch cage 92, and then through the timing gear 58 to the rotor shaft 56.

Disposed about the cylindrical portion 94, and in pressed fit relationship thereto, is a bearing set 96, and surrounding the bearing set 96 is a spring seat member 98 (also referred to hereinafter as a release plate), the outer periphery of the member 98 being in engagement with a rearward shoulder surface 100 of the cylindrical portion 80 of the clutch piston 76. The purpose of the above relationship of the spring seat member 98 and the clutch piston 76 will be described subsequently.

Seated against a forward surface of the bearing plate 54 is a plurality (of which two are shown in FIG. 3) of spring support members 102, each member 102 being surrounded by a coil compression spring 104, the forward end of each spring 104 being seated against the spring seat member 98. Disposed axially between the radially extending portion of the clutch housing 52 and the forward surface of the clutch piston 76 is an annular pressure chamber 106. Whenever relatively high pressure is communicated to the pressure chamber 106, the clutch piston 76 is moved rearwardly (to the right in FIG. 3) to a position in which the springs 104 are sufficiently compressed that the member 98 is disposed in contact with the forward end (left end in FIG. 3) of each of the support members 102. Thus, the members 102 also serve as travel "stops" for the springs 104 and the seat member 98.

As is used herein, the term "relatively high" pressure will be understood to mean high relative to the low pressure, or sump (reservoir) pressure which would be present in the pressure chamber 106 whenever the chamber 106 is drained, i.e., is communicated to a case drain region, such as that surrounding the timing gear 58 (and the other timing gear, not shown herein). However, it is also one important aspect of the invention that the "relatively high" pressure used to disengage the clutch pack 84 is preferably a pressure of only about 10 to 20 psi. (gauge). As was mentioned in the BACKGROUND OF THE DISCLOSURE, it is desirable to be able to operate the supercharger clutch using only the engine lubrication oil, for which the pressure would typically be about 20 psi. at the "end" of its flow path, which is where the supercharger clutch would be disposed.

When the piston 76 is moved to the right from the position shown in FIG. 3, the spring seat member 98 is also moved rearwardly, compressing the springs 104 as mentioned previously. With the springs 104 somewhat compressed, the clutch cage 92 is moved somewhat to the right in FIG. 3, and the loading of the clutch pack 84 is relieved sufficiently such that no substantial torque will be transmitted from the input shaft 64 to the clutch cage 92. In other words, no substantial input torque will be transmitted to the timing gear 58 or to the rotor shaft 56. Preferably, the unloading of the clutch pack 84 is sufficient to eliminate any "clutch drag", the presence of which would somewhat diminish the benefit of being able to de-clutch the supercharger.

In order to engage the clutch pack 84, and therefore, to drive the rotors of the supercharger, it is necessary to reduce the fluid pressure in the pressure chamber 106 from the relatively high pressure to a relatively low pressure (which could be sump or reservoir pressure). In the subject embodiment, the spring rate of the springs 104 has been selected such that, when the pressure in the chamber 106 is reduced to the relatively low pressure, the springs 104 will bias the seat member 98 forwardly (to about the position shown in FIG. 3) which, in turn, biases the bearing set 96 and the clutch cage 92 forwardly. Such forward movement of the radially extending wall of the clutch cage 92 will compress the clutch pack 84 against a radially extending lip 108 of the drive member 82.

Clutch Controls

It will be apparent to those skilled in the art that the time of engagement of the clutch assembly of the present invention is determined indirectly by the net force compressing the clutch pack 84. The compression force is determined by the fluid pressure in the pressure chamber 106, as it decreases from the relatively high pressure to a relatively lower pressure. In connection with the development of the present invention, it has been determined that it is an important aspect of the present invention to be able to modulate the rate of engagement of the clutch pack 84, in accordance with various vehicle and engine operating parameters, i.e., to reduce the pressure in the chamber 106, to a desired level, and therefore engage the clutch pack more rapidly or more slowly, depending upon various predetermined conditions. For example, when the engine is operating under a "part throttle" condition, it is desirable to achieve a longer time of engagement, whereas when the engine is operating under a "full throttle" condition, it is acceptable to engage the clutch pack more rapidly.

Figure 4:
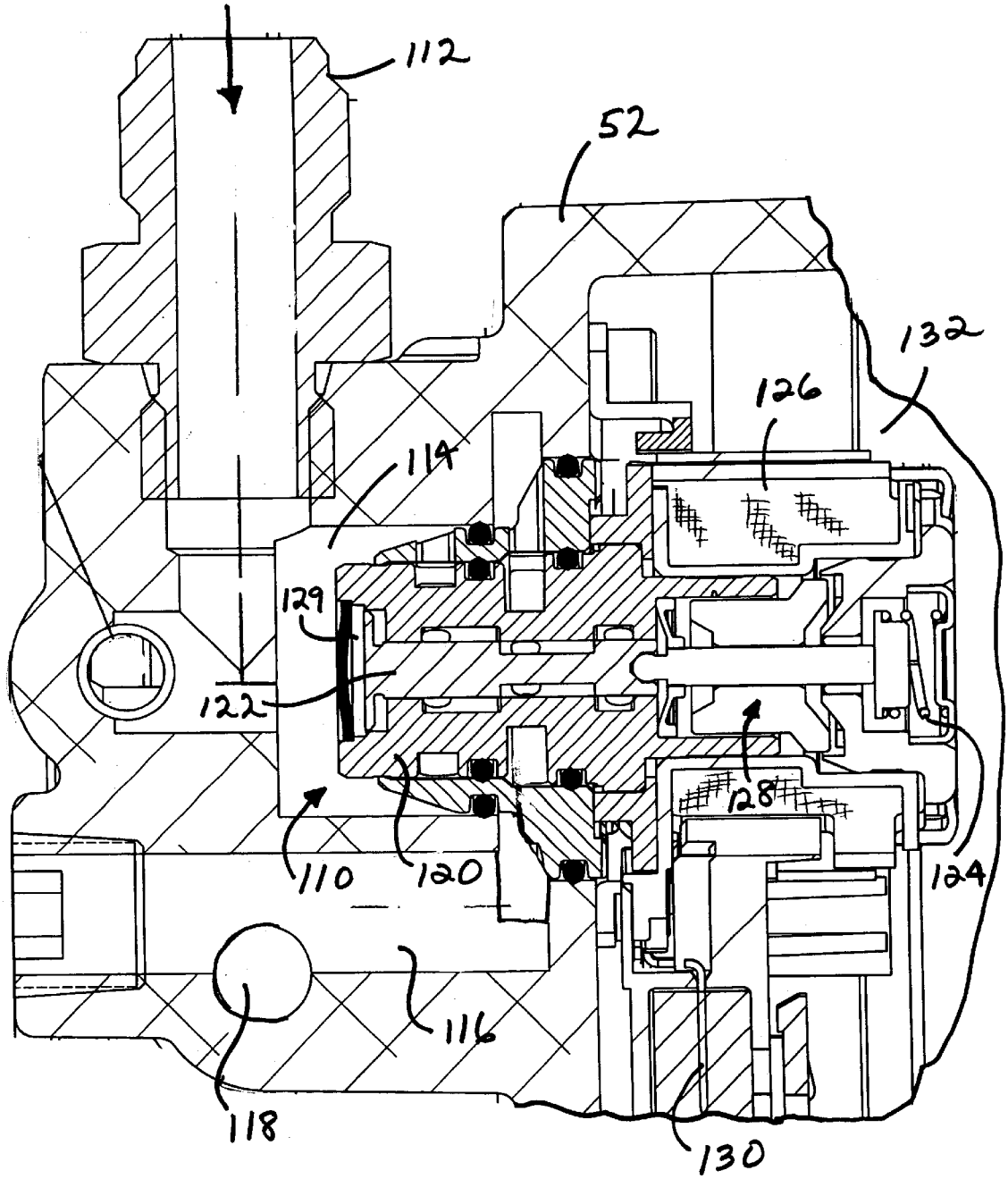
FIG. 4 is an enlarged, fragmentary, axial cross-section taken on line 4—4 of FIG. 2, and showing primarily the control valve assembly which comprises one aspect of the control method of the present invention.

Referring now primarily to FIG. 4, there is illustrated a control valve assembly, generally designated 110, of the type which may be used to control the pressure in the chamber 106. It will be understood by those skilled in the art, that the invention of this application is not limited to any particular type or configuration of control valve, or to any specific control logic. What is essential to the present invention is that the clutch assembly include some sort of control valving which is capable of modulating the pressure in the chamber 106 between the relatively high and relatively low pressures to achieve engagement and disengagement of the clutch pack 84 within the specified response times, and that the clutch assembly include some sort of control logic which is capable of achieving engagement of the clutch pack 84 at a controllable (modulatable) rate representative of some other predetermined vehicle parameter, such as throttle position.

Disposed in threaded engagement with the clutch housing 52 is a fitting 112 (see also FIG. 2), which is connected to a source of fluid pressure, such as the engine lubrication fluid, as was described previously. The clutch housing 52 also defines a chamber 114 in which is disposed the control valve assembly 110. The housing 52 also defines an axial passage 116 communicating with a transverse passage 118, which is in open communication with the pressure chamber 106.

The control valve assembly 110, which will be described only briefly hereinafter, may be of the general type illustrated and described in U.S. Pat. No. 4,947,893, assigned to the assignee of the present invention, and incorporated herein by reference. The control valve assembly 110 includes a valve body 120 and disposed for axial movement therein, a valve spool 122, the valve spool 122 being shown in FIG. 4 in a centered (or "neutral" position). The valve spool 122 is biased to the left in FIG. 4 by a compression spring 124, and can be moved to the right in FIG. 4 by means of an electromagnetic coil 126 which, when energized, biases an armature assembly 128 to the right, moving the valve spool 122 to the right also. Disposed at the left end of the valve spool 122 is a pressure feedback chamber 129 which, as is taught in the above-incorporated patent, is in communication with the fluid pressure present in the axial passage 116. Thus, the valve spool 122 is always being biased toward the right in FIG. 4 by whatever pressure is present in the pressure chamber 106.

In operation, with the coil 126 de-energized, the spring 124 biases the valve spool 122 to the left in FIG. 4, permitting communication of relatively high pressure from the chamber 114 through the valve assembly 110 to the axial passage 116, thus pressurizing the chamber 106, such that the piston 76 moves to the right in FIG. 3, disengaging the clutch pack 84, in the manner described previously. The above-described arrangement whereby the coil 126 is de-energized to disengage the clutch pack 84 is preferred because, in a typical vehicle application, the supercharger is disengaged for a greater part of the total duty cycle than it is engaged. More importantly, it is considered desirable that an electrical failure result in the supercharger clutch being disengaged. After the chamber 106 is pressurized to a relatively high pressure, that same pressure present in the feedback chamber 129 returns the valve spool 122 to the neutral position shown in FIG. 4.

When it is desired to operate the supercharger, by engaging the clutch pack 84, an appropriate electrical signal 130 is transmitted to the coil 126, moving the valve spool 122 to the right of the neutral position shown in FIG. 4, thus communicating the passage 116 (and therefore, the chamber 106) through the valve assembly 110 to a case drain region, illustrated generally as 132 in FIGS. 3 and 4. The decreasing pressure in the chamber 106 permits the springs 104 to bias the release plate 98 to the left, to the position shown in FIG. 3, as described previously, engaging the clutch pack 84. The rate of engagement (response time) of the clutch pack is determined by the pressure in the chamber 106, which in turn is controlled in response to changes in the electrical signal 130, such that a "soft engagement" may be achieved when that is desirable, or a more rapid engagement may be achieved when that is needed and is acceptable. Those skilled in the art will understand that in most supercharger installations, it is the engagement response time which is more critical, whereas the disengagement response time is typically less critical.

It is one important aspect of the present invention to be able to control the rate of engagement of the clutch pack 84, in accordance with some particular vehicle parameter, such as throttle position. Therefore, referring now primarily to FIGS. 5 and 6, in conjunction with FIG. 4, the method of controlling the engagement of the supercharger, including the control logic will be described.

Figure 5:
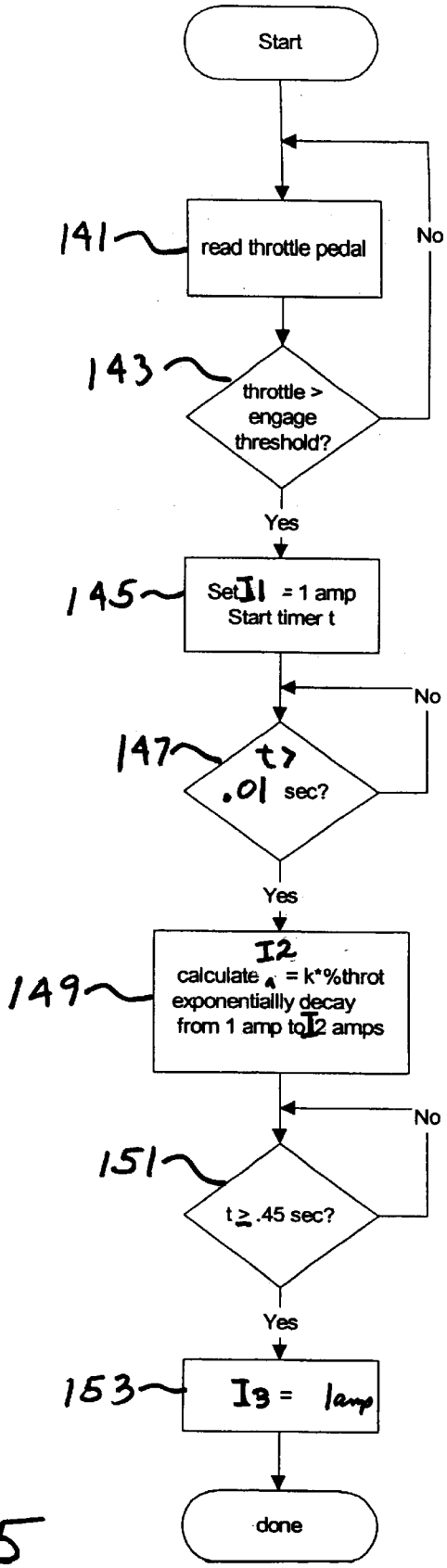
FIG. 5 is a logic flow diagram illustrating the control logic which comprises one aspect of the method of the present invention.

When it is desired to operate the supercharger, by engaging the clutch pack 84, and the electrical signal 130 is transmitted to the coil 126, the control logic shown in FIG. 5 is initiated by proceeding to "Start". The logic then proceeds to an operation block 141 which reads the position of the throttle pedal which, as is generally well known to those skilled in the art, will be generally representative of the rate of acceleration of the vehicle. The logic then proceeds to a decision block 143 in which the throttle position 141 is compared to a predetermined engagement threshold. Typically, and by way of example only, the threshold utilized in the decision block 143 would be somewhere in the range of about twenty percent to about 30 percent of full throttle. If the throttle position 141 is less than the threshold ("No"), the logic merely loops back, upstream of the operation block 141. If the throttle position 141 is greater than the threshold ("Yes"), the logic then proceeds to an operation block 145.

In the operation block 145, the command signal 130 (I1), the input to the electromagnetic coil 126, is set equal to one amp (see FIG. 6) and the logic timer is started. Those skilled in the art will understand that setting I1 equal to one amp is by way of example only, and is done primarily to be sure that the valve spool 122 does not "hang up", but is displaced enough that it can thereafter be moved to its desired position, as will be described subsequently. The logic then proceeds to a decision block 147 which interrogates the logic timer, and as long as the time t is not greater than 0.01 seconds ("No"), the logic merely loops back upstream of the decision block 147. When the time t has exceeded 0.01 seconds ("Yes"), the logic then proceeds to an operation block 149 in which a new command signal 130 (I2) is calculated.

Figure 6:
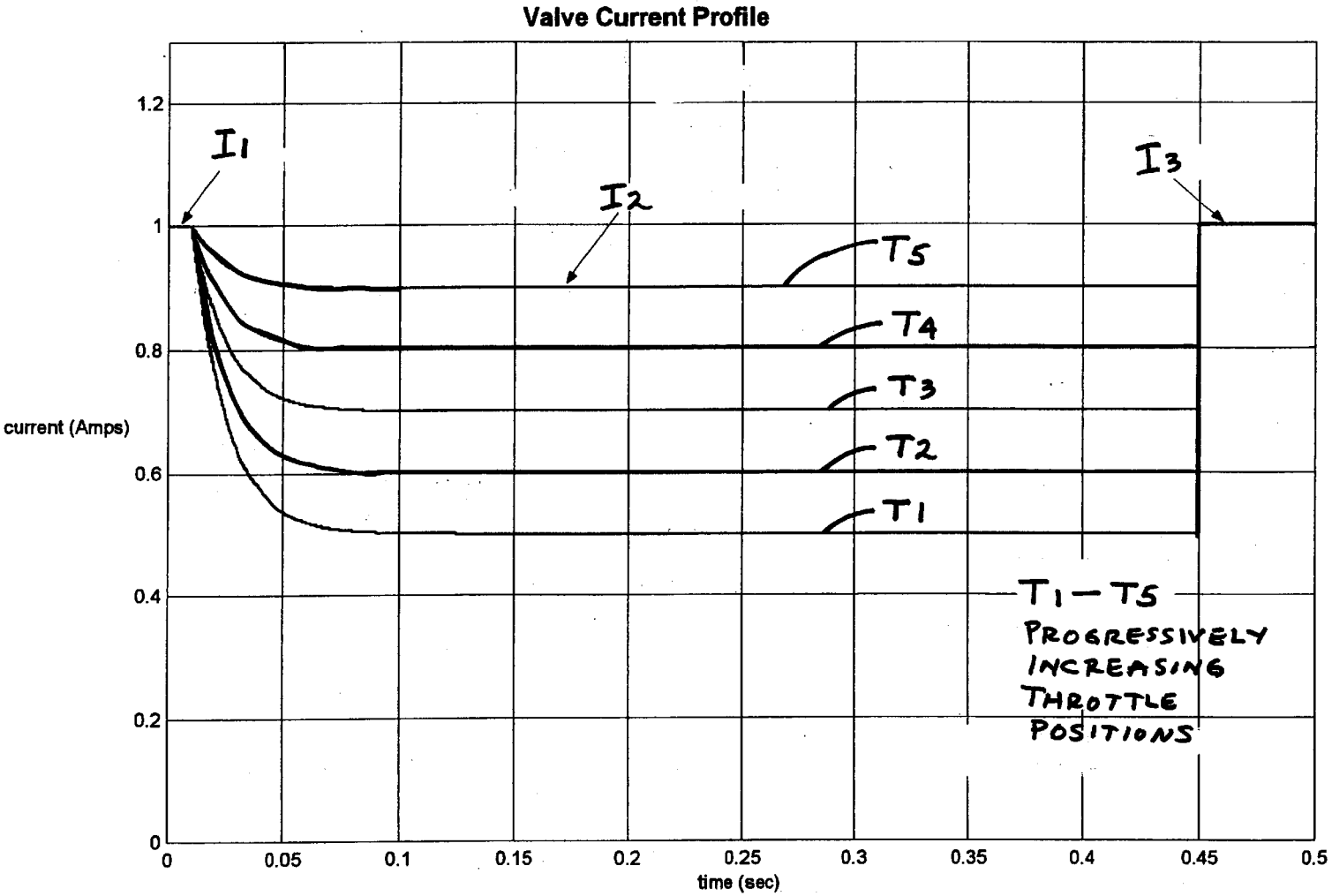
FIG. 6 is a graph of current versus time for the electromagnetic coil of the control valve assembly shown in FIG. 4, illustrating one aspect of the control method of the present invention.

In accordance with one important aspect of the invention, and as is shown in the graph of FIG. 6, the current I2 is calculated to correspond, in its steady state condition (after about t equals 0.1 seconds), to correspond to the throttle pedal position, read in operation block 141. However, as may be seen in FIG. 6, before the current I2 achieves its steady state condition, there is first an exponential decay from the initial condition (I1 equals one amp).

To illustrate one aspect of the invention, the graph of FIG. 6 shows five different values of I2, each corresponding to a different throttle pedal position, the positions being labeled T1 through T5, with the throttle position T1 representing a position just above the threshold of decision block 143, then T2 being a somewhat greater throttle position, etc., all the way up through T5 which may represent nearly a fall throttle position. As may also be seen in FIG. 6, the minimum throttle position T1 results in the signal I2 being set at approximately 0.5 amps, whereas the highest throttle position T5 results in the current I2 being set to about 0.9 amps.

Referring again to FIG. 4, the greater the magnitude of the current I2, the further to the right will the valve spool 122 be moved. As was described previously, the movement of the valve spool 122 to the right in FIG. 4 will be a function of the force exerted by the coil 126, plus the pressure in the feedback chamber 129, together opposing the force of the biasing spring 124. As the valve spool 122 is moved to the right, the pressure in the chamber 106 and in the axial passage 116 will be drained to the case drain region 132. Thus, the pressure in the chamber 106 and in the axial passage 116 will decrease, and there will be a corresponding decrease in the pressure in the feedback chamber 129, with the result that the valve spool 122 will tend to move back toward the neutral position shown in FIG. 4. However, in the meantime, the pressure in the chamber 106 will level off at a pressure corresponding to the current I2 which in turn corresponds to one of the throttle positions T1 through T5 as shown in FIG. 6.

Referring again to the logic of FIG. 5, after the operation block 149, the logic next proceeds to a decision block 151 in which the timer is interrogated to see if the time t is greater than 0.45 seconds. If not ("No") the logic merely loops back upstream of the decision block 151. As soon as the time t is equal to or greater than 0.45 seconds ("Yes"), the logic proceeds to an operation block 153 in which a new electrical command signal 130 (I3) is generated by merely setting I3 equal to one amp. By transmitting one amp to the coil 126, the logic ensures that the pressure chamber 106 will be sufficiently drained such that the springs 104 will bias the clutch pack 84 into full engagement, with no substantial opposing force from the piston 76. Thereafter, the supercharger clutch will operate in its fully engaged condition, such that no slipping occurs within the clutch pack 84. It should be understood by those skilled in the art that the particular current values shown and described herein are by way of example only, and not by way of limitation. Furthermore, the fact that the currents I1 and I3 both are set to one amp is not significant to the invention, but instead, all that is truly essential to the invention is that I2 be relatively lower, to modulate the engagement, and then I3 be relatively higher, to insure full engagement of the clutch pack 84.

By way of example only, it was found during the development of the present invention that for the throttle position T1 (I2 equal 0.5 amps), the result was an engagement time in the range of about 400 to 450 milliseconds whereas, at the other extreme, for the throttle position T5 (I2 equals 0.9 amps), the engagement time was in the range of about 100 to 150 milliseconds. As was described in the BACKGROUND OF THE DISCLOSURE, it was an important object of the invention to be able to modulate the rate of engagement (engagement time) of the supercharger clutch in response to varying vehicle parameters, such as throttle position.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A method of controlling a rotary blower of the backflow or compression type having an input, a housing defining a blower chamber, and a pair of blower rotors disposed in said blower chamber and adapted to be driven by said input, and a wet clutch disposed in series driving relationship between said input and said blower rotors, said wet clutch including spring means biasing said wet clutch toward one of an engaged and a disengaged condition, and a fluid pressure actuated piston having a pressure chamber biasing said wet clutch toward the other of said engaged and said disengaged conditions; said method of controlling characterized by:

(a) providing an electrohydraulic valve means operable to communicate said pressure chamber selectively to a source of high pressure and a source of low pressure;

(b) generating a command signal operable to bias said electrohydraulic valve means toward a position operable to communicate said pressure chamber to said source of whichever of said high pressure and said low pressure corresponds to said engaged condition;

(c) sensing a throttle position representative of change in commanded throttle position for the vehicle engine;

(d) modifying said command signal in response to said throttle position whereby a change between said engaged and said disengaged conditions will occur more rapidly for a more rapid change in commanded throttle position.

2. A method as claimed in claim 1 characterized by said spring means biasing said wet clutch toward said engaged condition, said fluid pressure actuated piston biasing said wet clutch toward said disengaged condition, and said step of providing said electrohydraulic valve means includes providing said command signal to said valve means to communicate said pressure chamber to said source of low pressure.

3. A method as claimed in claim 1 characterized by said step of sensing a throttle position comprises sensing a rate of change of commanded throttle position, and the step of modifying said command signal is performed generally proportionally to said rate of change of said throttle position.

4. A method as claimed in claim 2 characterized by said electrohydraulic valve means includes a spring biasing a valve member from its normal, neutral position toward a position communicating said pressure chamber to said source of high pressure, and an electromagnetic coil operable, when energized, to bias said valve member toward a position communicating said pressure chamber to said source of low pressure.

5. A method as claimed in claim 4, characterized by said electrohydraulic valve means defining a feedback pressure chamber in communication with a pressure representative of the pressure in said pressure chamber, said feedback pressure chamber being operable to bias said valve member in opposition to the force of said spring whereby, a decreasing pressure in said pressure chamber when said electromagnetic coil is energized will result in said valve member being biased toward said neutral position.

* * * * *